US005199409A

United States Patent [19]

Miyashita et al.

[11] Patent Number: 5,199,409

[45] Date of Patent: Apr. 6, 1993

[54] AIR/FUEL RATIO CONTROL SYSTEM FOR INTERNAL COMBUSTION ENGINE

[75] Inventors: Yukio Miyashita; Hiroshi Ohno; Shinichi Kubota, all of Wako, Japan

[73] Assignee: Honda Giken Kogyo Kabushiki Kaisha, Tokyo, Japan

[21] Appl. No.: 878,586

[22] Filed: May 5, 1992

[30] Foreign Application Priority Data

Jun. 14, 1991 [JP] Japan ..... 3-169457

[51] Int. Cl.[5] ..... F02D 41/14

[52] U.S. Cl. ..... 123/694; 123/488

[58] Field of Search ..... 123/488, 681, 682, 683, 123/687, 694, 695, 703

[56] References Cited

U.S. PATENT DOCUMENTS 3,973,529 8/1976 Wessel et al. ..... 123/695 X
4,494,374 1/1985 Kitahara et al. ..... 123/695 X
4,723,521 2/1988 Mieno et al. ..... 123/694 X
4,926,827 5/1990 Kato et al. ..... 123/488 X
5,036,819 8/1991 Peter et al. ..... 123/694 X
5,040,513 8/1991 Schnaibel et al. ..... 123/488

*Primary Examiner*—Willis R. Wolfe
*Attorney, Agent, or Firm*—Nikaido, Marmelstein, Murray & Oram

[57] ABSTRACT

A system for controlling an air/fuel ratio for an internal combustion engine, using an oxygen concentration sensor having a first chamber for introducing therein exhaust gas of the engine and a second chamber for introducing therein reference ambient air to detect oxygen content in the exhaust gas. In order to eliminate exhaust gas pulsation which could affect on detection accuracy, it is firstly determined if engine operation is in a transient state or in a normal state. Then the detected oxygen concentration value in the preceding cycle is added to the product obtained by multiplying the deviation between the values in the preceding and current cycles by a coefficient α. The coefficient is made different in the transient state and in the normal state. In the normal engine operation state, the coefficient α is determined from engine speed and load.

12 Claims, 5 Drawing Sheets

FIG. 7

| | PB1 | PB2 | PB3 |
|---|---|---|---|
| NE1 | $\alpha$ 11 | $\alpha$ 12 | $\alpha$ 31 |
| NE2 | $\alpha$ 21 | $\alpha$ 22 | $\alpha$ 32 |
| NE3 | $\alpha$ 31 | $\alpha$ 23 | $\alpha$ 33 |
| NE4 | $\alpha$ 41 | $\alpha$ 24 | $\alpha$ 34 |
| NE5 | $\alpha$ 51 | $\alpha$ 25 | $\alpha$ 35 |

AIR/FUEL RATIO CONTROL SYSTEM FOR INTERNAL COMBUSTION ENGINE

BACKGROUND OF THE INVENTION

1. Field of the Invention

This invention relates to an air/fuel ratio control system for an internal combustion engine, more particularly to an air/fuel ratio control system for an internal combustion engine in which control hunting is reduced by decreasing the effect of exhaust gas pulsation on the detected air/fuel ratio.

2. Description of the Prior Art

A number of techniques have been proposed for controlling the air/fuel ratio in an internal combustion engine based on the oxygen concentration of the exhaust gas from the engine measured using a sensor comprising an oxygen ion-conductive solid electrolyte material. As specific examples there can be mentioned in Japanese Laid-Open Patent Publication Nos. 61-272438 (U.S. Pat. No. 4,842,711) and 62-3143.

Sensors of this type generally have two bodies each composed of oxygen ion-conductive solid electrolyte material disposed opposite each other and each provided with a pair of electric terminals so as to constitute an oxygen-pumping element and a cell element for detecting oxygen concentration. More specifically, the space between the oxygen pumping element and the cell element is sealed off to form a gas diffusion chamber (diffusion restriction region). The wall of the chamber is provided with a slit for the introduction of exhaust gas, while ambient air is introduced on the opposite side of the cell element. The electromotive force developed between the terminals of the cell element is detected and compared with a reference voltage. A voltage proportional to the difference between the two voltages is applied across the oxygen-pumping element terminals so as to cause pumping current to flow from the external terminal toward the gas diffusion chamber terminal or vice versa and thus pump in or pump out oxygen ions. The pumping current is thus feedback controlled in the direction for reducing the difference between the electromotive force of the cell and the reference voltage. The pumping current value is converted to a voltage value proportional to the oxygen concentration. As a result it becomes possible to detect the air/fuel ratio over a wide range extending from a rich to a lean mixture.

However, the exhaust gas to which the oxygen concentration sensor of this type is exposed pulsates in a manner that changes as the operating condition of the engine changes and, as a result, the aforesaid pumping current, which is affected by the exhaust gas pulsation, also varies depending on the operating condition of the engine. When the raw value of the oxygen concentration detected by the sensor is used for controlling the air/fuel ratio, control hunting occurs. For reducing the effect of the exhaust gas pulsation on the detection value and thus suppressing control hunting it has been proposed to correct the detection value in accordance with the engine speed and engine load (Japanese Laid-Open Utility Model Publication No. 64-32442), to smooth the detection value in accordance with the engine speed and engine load (Japanese Laid-Open Patent Publication Nos. 62-96754 and 1-206251), and to vary a constant at each instant in accordance with the engine speed (Japanese Laid-Open Patent Publication Nos. 61-272439 (U.S. Pat. No. 4,767,520) and 61-294358).

Since these prior art technologies do not detect the change in exhaust gas pulsation with variation in various operating parameters and the operating condition of the engine, they are not able to prevent the control hunting to an adequate degree.

An object of this invention is therefore to eliminate the aforesaid problem by providing an air/fuel ratio control system for an internal combustion engine which reduces control hunting by decreasing the effect of exhaust gas pulsation on the detected air/fuel ratio.

Moreover, the prior art has not given adequate attention to the fact that the engine operating condition differs greatly between normal and transient (accelerating or decelerating) operation.

Another object of the invention is therefore to provide an air/fuel ratio control system for an internal combustion engine which is able to reduce control hunting by decreasing the effect of exhaust gas pulsation on the detected air/fuel ratio, irrespective of whether the engine is in a normal or a transient operating state.

SUMMARY OF THE INVENTION

This invention achieves this object by providing a system for controlling an air/fuel ratio for an internal combustion engine using an oxygen concentration sensor, said oxygen concentration sensor having an oxygen-pumping element and a cell element, each being composed of a member of a solid electrolytic material having oxygen ion-conductivity and a pair of electrodes having said member interposed therebetween, said oxygen-pumping element and said cell element defining a diffusion restriction region therebetween, voltage applying means connected to said oxygen-pumping element for applying an output voltage, corresponding to a difference between a voltage developed between said electrodes of said cell element and a predetermined reference voltage, to said oxygen-pumping element, and current detecting means connected to said oxygen-pumping element for detecting a value of current flowing therein. The system comprises first means for detecting a plurality of operating conditions of the engine, second means for smoothing the detected oxygen concentration at a rate determined in response to the detected engine operating conditions and control means for controlling an air/fuel ratio of the engine in response to the smoothed value.

BRIEF EXPLANATION OF THE DRAWINGS

These and other objects and advantages of the invention will be more apparent from the following description and drawings, in which:

FIG. 7 is an explanatory view showing the characteristics of an averaging coefficient in a normal engine operating state used in the flowchart of FIG. 6.

DESCRIPTION OF THE PREFERRED EMBODIMENTS

An embodiment of the invention will now be explained with reference to the drawings.

Figure 1:
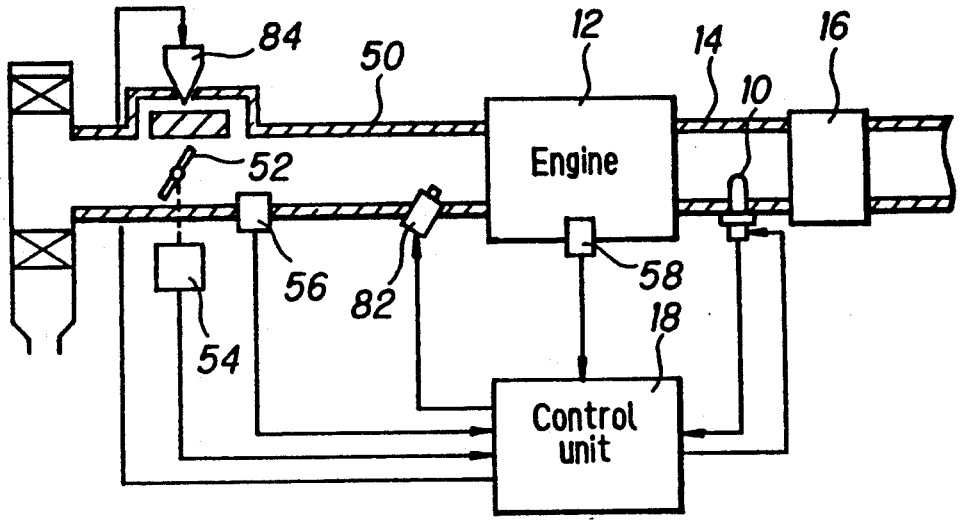
FIG. 1 is an explanatory view showing an air/fuel ratio control system for an internal combustion engine.

FIG. 1 shows an overall arrangement of an air/fuel ratio control system for an internal combustion engine. Referring to FIG. 1, an oxygen concentration sensor (hereinafter called "the oxygen sensor") 10 is installed in an exhaust pipe 14 of an internal combustion engine 12 at a position upstream of a three-way catalytic converter 16. The oxygen sensor 10 is electrically connected with a control unit 18.

Figure 2:
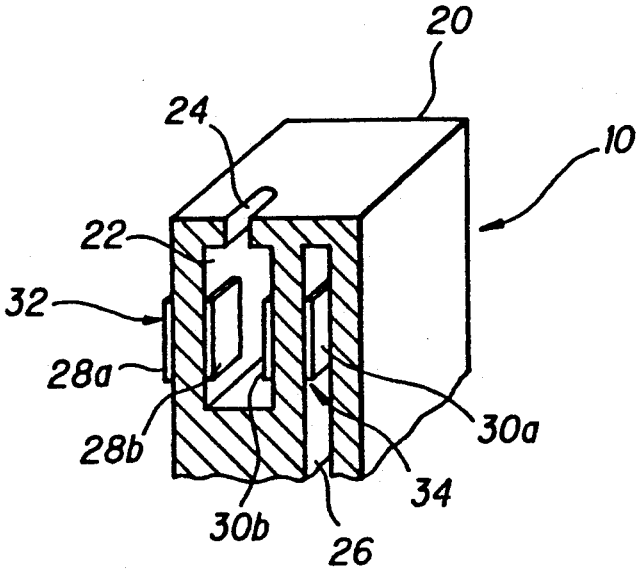
FIG. 2 is an enlarged perspective partial view of an oxygen concentration sensor shown in FIG. 1.

FIG. 2 is an enlarged perspective view of the essential part of the oxygen sensor 10 shown with its protective cover removed. As shown, the oxygen sensor 10 has a main body formed as an oxygen ion-conductive solid electrolytic member 20. The left side of the main body 20 as seen in the drawing is partitioned to form a gas diffusion chamber 22 having an inlet slit 24 which serves for introducing exhaust gas into the gas diffusion chamber 22 from the exhaust pipe 14. On the right side of the main body 20 partitioned from the gas diffusion chamber 22 by a wall is an air reference chamber 26 for introduction of ambient air. A pair of electrodes 30*a*, 30*b* are provided on opposite sides of the wall between the gas diffusion chamber 22 and the air reference chamber 26 and a pair of electrodes 28*a*, 28*b* are provided on opposite sides of the other side wall of the gas diffusion chamber 22. This arrangement enables the solid electrolytic member 20 and the electrodes 28*a*, 28*b* to function as an oxygen-pumping element 32 and the solid electrolytic member 20 and the electrodes 30*a*, 30*b* to function as a cell element 34.

Figure 3:
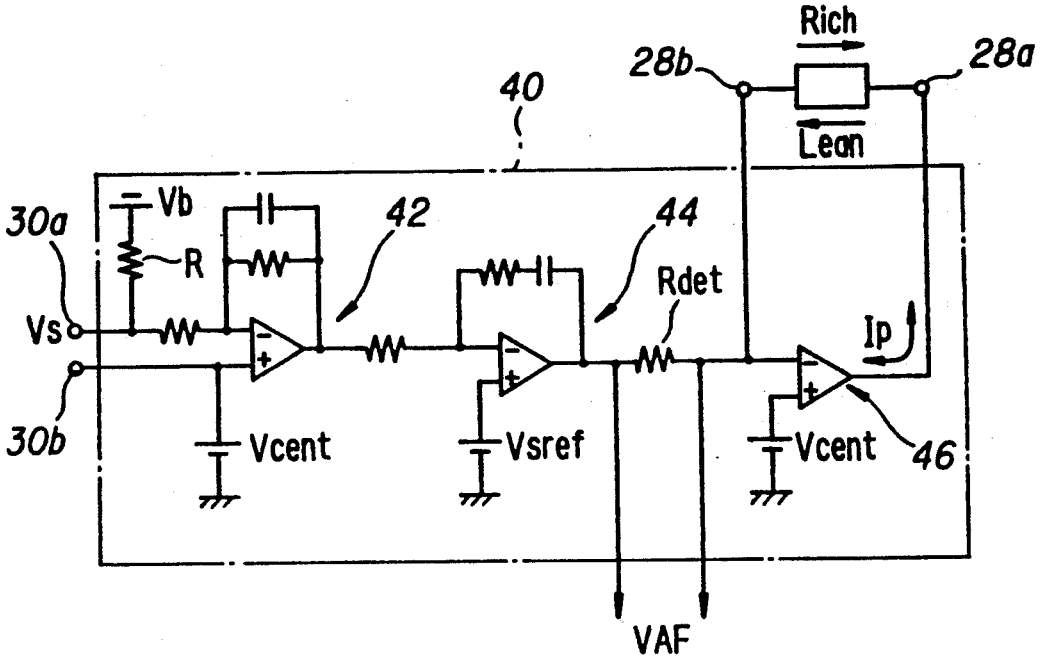
FIG. 3 is a diagram of a detection circuit of the sensor shown in FIG. 2.
Figure 4:
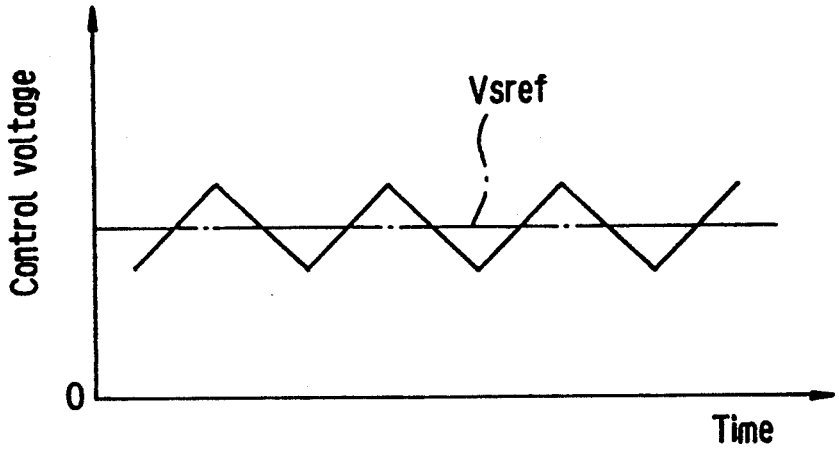
FIG. 4 is an explanatory view illustrating characteristics of an output of a proportional-plus-integral operational amplifier shown in FIG. 3.

FIG. 3 is a schematic diagram of a detection circuit 40 connected with the aforesaid group of electrodes. As will be noted in this diagram, the detection circuit 40 consists of an inverting operational amplifier 42 for detecting and amplifying the electromotive force Vs developed between the cell electrodes 30*a*, 30*b*, a proportional-plus-integral operational amplifier 44 for comparing the output of the inverting operational amplifier 42 with a reference voltage Vsref and outputting a control voltage like that shown in FIG. 4, and a voltage/current converter 46 for converting the output of the proportional-plus-integral amplifier 44 to a current value. The detection value VAF is obtained as the voltage across a resistor Rdet. (A prescribed voltage Vcent is applied between the electrodes 28*b*, 30*b* on the gas diffusion chamber 22 side.)

The essence of the measuring operation is as follows. When the oxygen concentration in the gas diffusion chamber 22 is lower than a prescribed level, the pump current Ip flows in the direction of the "lean" arrow, whereby oxygen ions are transferred in the reverse direction and thus pumped out of the diffusion chamber. On the other hand, when the oxygen concentration in the gas diffusion chamber 22 is higher than the prescribed level, the pumping current Ip flows in the opposite (rich) direction, whereby oxygen ions are pumped into the dispersion chamber. The oxygen concentration in the gas diffusion chamber 22 is thus closed-loop controlled to a prescribed level by the pumping current. The reference voltage Vsref is set at an appropriate value and variations in the pumping current are detected as voltage variations through the detection resistor Rdet. The detected value is then linearized in an appropriate manner to obtain a value in proportion to the oxygen concentration in the exhaust gas over a wide range extending from a lean to a rich mixture.

Returning to FIG. 1, the system is further provided with a throttle position sensor 54 for detecting the degree of opening of a throttle valve 52 in an air intake pipe 50, an absolute pressure sensor 56 for detecting the absolute engine intake air pressure (manifold pressure), and a crankshaft sensor 58 for detecting the crank angle positions of the engine's pistons (not shown). The detection signals from these sensors are forwarded to the control unit 18.

Figure 5:
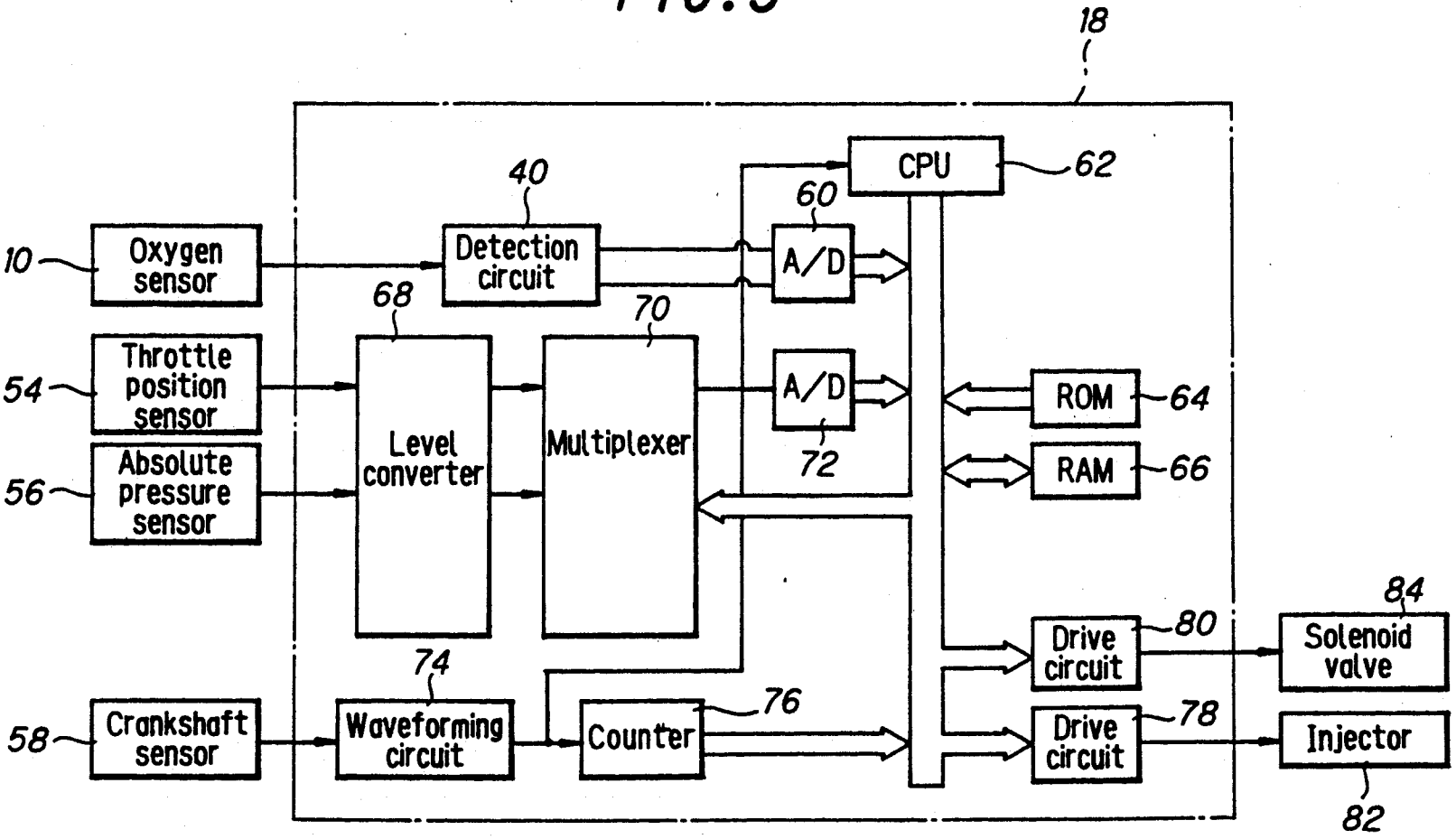
FIG. 5 is a block diagram of a control unit shown in FIG. 1.

The arrangement of the control unit 18 is shown in the block diagram of FIG. 5. The output of the detection circuit 40 is forwarded through an A/D converter 60 to a microcomputer comprising a CPU (central processing unit) 62, a ROM (read-only memory) 64 and a RAM (random access memory) 66 where it is stored in the RAM 66. In addition, the microcomputer receives the analog outputs from the throttle position sensor 54 and the like through a level converter 68, a multiplexer 70 and a second A/D converter 72, and receives the output of the crankshaft sensor 58 through a waveforming circuit 74 and a counter 76. The CPU 62 of the microcomputer calculates the air/fuel ratio control value in a manner explained later in accordance with commands stored in the ROM 64 and drives an injector 82 and a solenoid valve 84 for secondary air supplier via drive circuits 78, 80.

Figure 6:
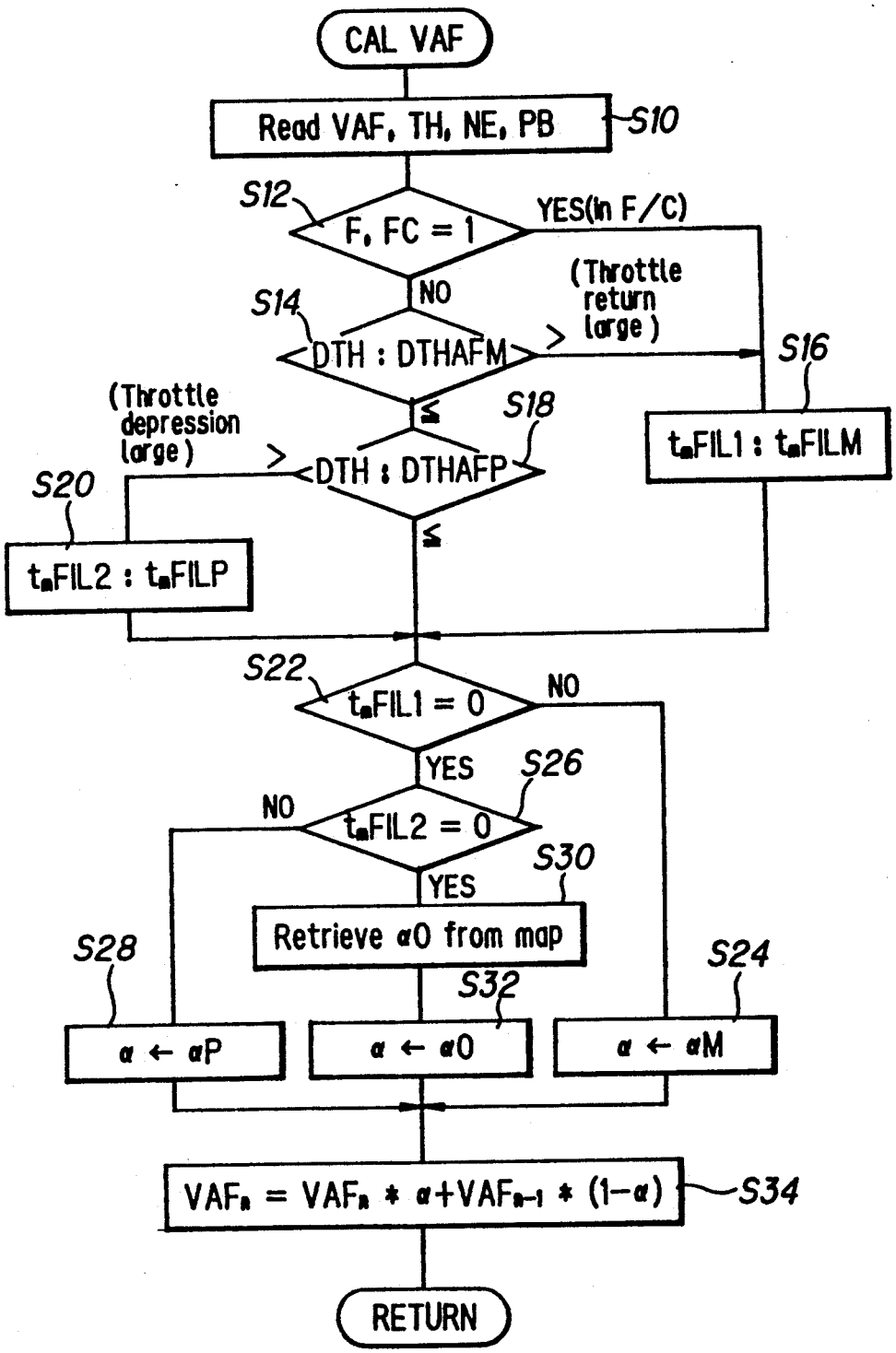
FIG. 6 is a flowchart showing the mode of operation of the unit.

The operation of the system will now be explained with reference to the flowchart of FIG. 6. The program according to this flowchart is started once every prescribed crankangle, e.g. at TDC.

After starting the program, the detected oxygen concentration VAF, and other parameters indicating operating condition of the engine, i.e., throttle opening TH, engine speed NE and intake air pressure PB are read in in step S10. The program then goes to step S12 in which a check is made as to whether or not the bit of a flag F.FC is 1, so as to determine whether or not fuel cut-off has been implemented. The bit of this flag is set to 1 in the aforesaid microcomputer at the time of implementing fuel cut-off and the judgment in this step is made by checking this flag.

If the result in step S12 is negative, the program advances to step S14 in which the amount of change (first-order difference) DTH in the throttle opening TH per unit time is calculated and compared with a prescribed value DTHAFM. The amount of change DTH is calculated by subtracting DTHn (value detected in the current cycle) from DTHn-1 (value detected in the preceding cycle). When it is found in step S14 that the amount of change exceeds the prescribed value, it is judged that the amount of throttle opening return is large, i.e. that the engine is in a decelerating operating state, and the program advances to step S16 in which a timer clock tmFIL1 (a countdown clock) is set to a first value tmFILM and countdown is commenced.

When the engine is not found to be in a decelerating operating state in step S14, the program goes to step S18 in which the amount of throttle opening change DTH is calculated in the opposite manner from that in step S14 by subtracting DTHn-1 (value detected in the preceding cycle) from DTHn (value detected in current cycle) and the result is compared with a second prescribed value DTHAFP. When it is found in step S18 that the amount of change exceeds the prescribed value, it is judged that the amount of throttle opening increase is large (that the amount of accelerator depression has increased). Since this means that the engine is in an accelerating operating state, the program moves to step S20 in which a second timer clock tmFIL2 (a countdown clock) is set to a second value tmFILP and countdown is commenced.

The program then goes to step S22, where a check is made as to whether the first timer clock has reached zero. If the amount of time prescribed by this timer clock has not yet passed since the start of the decelerating operating state, the result in step S22 is negative and the program advances to step S24 in which a value $\alpha M$ is set to $\alpha$ (to be explained later). If the prescribed amount of time has passed and the decelerating operating state has ended or if the engine was not in a decelerating operating state from the beginning, the result in step S22 is affirmative and the program moves to step S26 in which a check is made as to whether the value of the second timer clock has reached zero. If the amount of time prescribed by this timer has not yet passed since the start of the accelerating operating state, the result in step S26 is negative and the program advances to step S28 in which a value $\alpha P$ is set to $\alpha$.

If the result in step S26 is affirmative and the engine is in neither a decelerating operating state nor a accelerating operating state, i.e. in a normal operating state, the program advances to step S30 in which the value $\alpha 0$ is retrieved from a map. The characteristics of the map are shown in FIG. 7, from which it will be understood that the value $\alpha 0$ is defined as a function of the engine speed NE and the manifold pressure (intake air pressure) PB. The value $\alpha 0$ is thus retrieved from the map in step S30 using the engine speed and the manifold pressure read in step S10 as address data.

The program then advances to the last step S34 in which the detected oxygen content VAFn is adjusted using the equation shown in the drawing. Here, VAFn means a value detected in the current cycle and VAFn-1 a value detected in the preceding cycle. And as will be understood from this equation, the value $\alpha$ is a correction coefficient for obtaining a weighted mean. Specifically, the coefficient $\alpha$ determined in accordance with the operating state is used to obtain a weighted mean calculated from the current and preceding cycle detection values that is used as the oxygen content in the current cycle. Accordingly, based on the averaged oxygen content, the CPU 62 of the microcomputer determines the air/fuel ratio control value.

As was explained above, when the engine is in a normal operating state, the smoothing coefficient $\alpha$ is obtained by retrieval from the map of FIG. 7 using the engine speed and the manifold pressure (intake air pressure) as address data. It must be remembered, however, that the exhaust gas pulsation varies with engine load (specifically grows larger with increasing engine load) and with engine speed (specifically peaks within the low engine speed region). Since the oxygen content detected increases with increasing exhaust gas pulsation, the characteristics indicated by FIG. 7 are such that the value $\alpha$ is varied and weighted in accordance with the magnitude of the exhaust gas pulsation. That is to say, the value $\alpha$ is made relatively small in the region where the exhaust gas pulsation is large and made relatively large in the region where the exhaust gas pulsation is small. In the equation shown in step S34 the value in the preceding cycle is added to the product obtained by multiplying the deviation between the values in the preceding and current cycles by the coefficient $\alpha$. Thus when the value $\alpha$ is set in the foregoing manner, the averaging rate can be maintained constant irrespective of increase/decrease of the exhaust gas pulsation. The effect of exhaust gas pulsation can thus be reduced, making it possible to suppress control hunting.

The reason for changing the averaging coefficient during transient operation is that, during accelerating operating state for example, the manifold pressure continues to increase monotonously for a certain period following acceleration, thus prolonging the exhaust gas pulsation fluctuation period. Therefore the coefficient $\alpha P$ is made larger than the coefficient $\alpha 0$ for normal operating state so as to enhance response by speeding up the smoothing. During decelerating operating state, the manifold pressure decreases monotonously for a certain period, again leading to prolongation of the exhaust gas pulsation period. Therefore the coefficient $\alpha M$ is made larger than $\alpha 0$, also. From this it will also be understood that the values to which the timer clocks FIL1 and FIL2 are set in steps S16 and S20 are appropriately selected to correspond to the periods of monotonous increase and decrease.

In the embodiment of the foregoing arrangement, since during normal operating state the averaging rate is varied in accordance with the engine speed and the engine load so as to realize a fixed degree of averaging irrespective of fluctuation in the exhaust gas pulsation, the effect of the exhaust gas pulsation on the detected air/fuel ratio can be made smaller than that in the prior art, whereby control hunting can also be reduced. Moreover, in view of the fact that the averaging rate is changed between normal operating state and transient operating state, whereby response is enhanced by speeding up the averaging during transient operating state when the effect of exhaust gas pulsation is relatively small, and the fact that the averaging rate is fixed in the aforesaid manner during normal operating state, it becomes possible to realize a fixed degree of averaging irrespective of whether the engine is in a normal operating state or a transient operating state and as a result to obtain highly effective control.

While this embodiment has been explained with respect the case where the smoothing coefficient $\alpha 0$ is varied as a function of the engine speed and the engine load, it is also possible to vary it as a function of the target air/fuel ratio. More specifically, since, if a fluctuation in pump current is constant, the oxygen content VAF is larger on a lean mixture than on a rich mixture , it is possible to reduce the effect of the pulsation by making coefficient $\alpha 0$ small on the rich mixture and large on the lean mixture. It is also possible to combine the two methods of varying the coefficient.

And, although the weighted mean is used for smoothing the sensor output, any other smoothing technique such as simple averaging, moving averaging or the digital filtering and the like can be used.

As the oxygen sensor in the embodiment described above it is possible to use one having an internal reference oxygen source, as described, for example, in Japanese Laid-Open Patent Publication No. 62-276453.

The present invention has thus been shown and described with reference to the specific embodiments. However, it should be noted that the present invention is in no way limited to the details of the described arrangements but changes and modifications may be made without departing from the scope of the appended claims.

What is claimed is:

1. A system for controlling an air/fuel ratio for an internal combustion engine using an oxygen concentration sensor;

said oxygen concentration sensor having an oxygen-pumping element and a cell element, each being composed of a member of a solid electrolytic material having oxygen ion-conductivity and a pair of electrodes having said member interposed therebetween, said oxygen-pumping element and said cell element defining a diffusion restriction region therebetween;

voltage applying means connected to said oxygen-pumping element for applying an output voltage, corresponding to a difference between voltage developed between said electrodes of said cell element and a predetermined reference voltage, to said oxygen-pumping element; and current detecting means connected to said oxygen-pumping element for detecting a value of current flowing therein;

comprising:

first means for detecting a plurality of operating conditions of the engine;

second means for smoothing the detected oxygen concentration at a rate determined in response to the detected engine operating conditions; and control means for controlling an air/fuel ratio of the engine in response to the smoothed value.

2. A system according to claim 1, wherein the operating conditions include engine speed.

3. A system according to claim 2, wherein the rate is determined to be large in the low engine speed.

4. A system according to claim 1, wherein the operating conditions include engine load.

5. A system according to claim 4, wherein the rate is determined to be increased as the engine load increases.

6. A system according to claim 1, wherein the operating conditions include engine speed and engine load.

7. A system according to claim 1, wherein said second means averages to smooth the detected oxygen concentration by adding the one detected in a preceding combustion cycle to the product obtained by multiplying the deviation between the ones detected in the preceding and current cycles by a coefficient determined in response to the detected operating condition.

8. A system for controlling an air/fuel ratio for an internal combustion engine, using an oxygen concentration sensor;

said oxygen concentration sensor having an oxygen-pumping element and a cell element, each being composed of a member of a solid electrolytic material having oxygen ion-conductivity and a pair of electrodes having said member interposed therebetween, said oxygen-pumping element and said cell element defining a diffusion restriction region therebetween;

voltage applying means connected to said oxygen-pumping element for applying an output voltage, corresponding to a difference between a voltage developed between said electrodes of said cell element and a predetermined reference voltage, to said oxygen-pumping element; and current detecting means connected to said oxygen-pumping element for detecting a value of current flowing therein;

comprising:

first means for discriminating if the engine operation is in a transient state;

second means for smoothing the detected oxygen content at a rate determined in response to the detected engine operation state; and control means for controlling an air/fuel ratio of the engine in response to the smoothed value.

9. A system according to claim 8, wherein said second means averages to smooth the detected oxygen concentration by adding the one detected in a preceding combustion cycle to the product obtained by multiplying the deviation between the ones detected in the preceding and current cycles by a coefficient determined in response to the detected engine operation state.

10. A system according to claim 9, wherein said coefficient is made larger in the transient condition than that in the state other than the transient state.

11. A system according to claim 8, further including;

third means for detecting a plurality of operating conditions of the engine; and said second means averages to smooth the detected oxygen concentration at a first rate when the engine operation is in the transient state and when the engine operation is not in the transient state, averages to smooth the detected oxygen concentration at a second rate determined in the detected engine operating conditions.

12. A system according to claim 11, wherein the operating conditions include, solely or in combination, engine speed and engine load.

* * * * *